United States Patent [19]

Kessler et al.

[11] Patent Number: 4,682,704

[45] Date of Patent: Jul. 28, 1987

[54] FLOATING CAP SEAL

[75] Inventors: Ronald N. Kessler, Girard; Myron E. Ullman, Canfield, both of Ohio

[73] Assignee: Boardman Molded Products, Inc., Youngstown, Ohio

[21] Appl. No.: 931,025

[22] Filed: Nov. 17, 1986

Related U.S. Application Data

[63] Continuation-in-part of Ser. No. 862,455, May 12, 1986, abandoned.

[51] Int. Cl.[4] ..... B65D 53/04

[52] U.S. Cl. ..... 215/329; 215/349; 215/350; 215/351

[58] Field of Search ..... 215/351, 350, 349, 329, 215/342

[56] References Cited

U.S. PATENT DOCUMENTS

| | | | |
|---|---|---|---|
| 1,978,946 | 10/1934 | Horner | 215/351 X |
| 3,612,325 | 10/1971 | Williams | 215/329 |
| 4,381,840 | 5/1983 | Ostrowsky | 215/350 X |
| 4,531,649 | 7/1985 | Shull | 215/351 X |

FOREIGN PATENT DOCUMENTS

| | | | |
|---|---|---|---|
| 817415 | 7/1959 | United Kingdom | 215/350 |

*Primary Examiner*—Donald F. Norton

*Attorney, Agent, or Firm*—Browdy and Neimark

[57] ABSTRACT

A floating cap seal for sealing containers whose openings are equipped with non-planar surfaces includes a seal which floats upon a ring permitting the seal to effectively seal uneven vessel opening surfaces.

19 Claims, 10 Drawing Figures

FLOATING CAP SEAL

FIELD OF THE INVENTION

This is a continuation-in-part of copending parent application Ser. No. 862,455, filed May 12, 1986 and now abandoned. The present invention relates to cap seals, and more particularly to a cap seal of the floating type for use in conjunction with container closures.

BACKGROUND OF THE INVENTION

For many years solvents such as hydrogen peroxide, bleach and other like chemical liquids have been sold in blow molded plastic containers. Due to the fact that these containers are mass-produced in halves which are brought together to form bottles having longitudinal seams along the mold lines, the bottle halves are often slightly misaligned and as a result the bottle openings include a somewhat non-planar abutting closure surface. Thus, these containers often have openings provided with one region of the closure surface higher in elevation than the adjacent surface. As a result, closures and caps abutted thereto have a tendency to incompletely seal, and as a result to leak the liquid from within the container.

Indeed, other types of bottles may also have openings which are not entirely uniform, and this can occur regardless of how the bottle is formed. Even with glass bottles, the uniformity of the bottle neck may be sufficiently irregular so that sealing with the bottle cap is imperfect. This problem sometimes arises in glass bottles in the form of an oval rather than a circular neck. Thus, while the problem is particularly acute in plastic bottles which are formed between mating mold halves, the problem of irregular bottle openings can occur in any kind of bottle.

Attempts have been made over the years to place or insert a disk or gasket or liner within the cap to insure a proper seal between the cap and the surface of the bottle opening. For example, U.S. Pat. Nos. 4,256,234 to Mori et al; 4,351,443 to Uhlig; and 4,476,987 to Nolan all show container closures or caps provided with gasket inserts to facilitate a seal between the cap and the container's opening surface. Other patents of the same general type are Breskin U.S. Pat. No. 4,489,844; Banich U.S. Pat. No. 4,346,812; Kornelis U.S. Pat. No. 4,244,481 and Ostrowsky U.S. Pat. No. 4,427,126. These above-mentioned patents concern gaskets which abut directly against the cap's bottom wall and therefore do not solve the aforementioned problem of providing proper seal in containers having uneven closure opening surfaces.

A particularly satisfactory product of the prior art is disclosed in the Williams U.S. Pat. No. 3,612,325. This patent discloses a liner inserted adjacent the bottom wall of a bottle closure in such a way as to be allowed to rotate independently of the closure, so that the sealing bottle edge does not scrape or rotate with respect to the bottle top. When the liner does not turn with the closure but is able to rotate, it is able to seal vertically on the bottle top. With a flash line on the top of the bottle, the liner approaches the flash vertically and does not rotate over the flash line thereby causing the seal to stick or bear against the flash line.

Nevertheless, in spite of this superior functioning, in extreme cases of the aforementioned imperfections, the semi-floating seal of the Williams '325 patent is not sufficient. Thus, it has been proposed to use a very thick liner, which may be as thick $\frac{1}{8}$ to $\frac{1}{4}$-inch or more, to fill the voids and cracks caused by whatever imperfection in the bottle top may exist. Such thick liners require additional cap height as well as the additional liner thickness, both of which add expense to the product. Not only does this additional expense occur on bottles with imperfections, but also the expense occurs on bottles that have a minimum of imperfections because it is uneconomical to sort the good bottles from the bad ones and use different types of caps and liners for each group. Thus, all bottles require the additional expense, needed or not.

In addition to the expense of the added height of the cap and thickness of the liner, there is a further complication because bottle capping machines have a torque setting that requires constant adjustment depending on the variable amounts of friction the imperfections impart to a thick liner. Standards in the industry require certain amounts of application torque and backoff torque, and a thick liner complicates this adjustment.

Unlike the Williams U.S. Pat. No. '325, the patent to Herbert U.S. Pat. No. 4,564,117 provides means for preventing rotation of the liner gasket relative to the cap. This defeats the beneficial results of the Williams U.S. Pat. No. '325 as mentioned above. These means take the form of shallow, rounded annular ribs located directly above the edge of the bottle top. As illustrated in the left-hand portion of the sole figure, upon tightening the cap the annular ribs project into the surface of the gasket and prevent its rotation relative to the cap.

Thus, the art has so far failed to provide a satisfactory solution to the problem outlined above resulting from imperfections which occur during formation of the bottle.

SUMMARY OF THE INVENTION

Accordingly, it is an object of the present invention to overcome deficiencies of the prior art, such as those set forth above.

It is a further object of the present invention to provide for improved sealing of imperfectly formed bottles.

It is another object of the present invention to provide an improved cap sealing construction for use in conjunction with molded containers, especially molded plastic bottles.

It is yet another object of the present invention to provide a cap having a floating seal.

It is still another object of the present invention to provide a cap construction which can effectively seal an uneven container opening.

It is yet a further object of the present invention to provide a cap which, by virtue of its ability to move axially relative to and on the edge of the bottle neck, can effectively absorb sudden shocks and/or internal pressure buildups within the bottle, the latter of which may occur due to a buildup of gas pressure within the bottle or, in the case of a flexible bottle, due to compression of the bottle sidewall.

It is still a further object of the present invention to provide a cap with a seal which will not easily be worn.

It is another object of the present invention to provide a cap construction of the above type which is inexpensive to mass produce.

It is still another object of the present invention to provide a seal of the floatable type which can be inserted into already existing conventional caps or closures with ease and simplicity.

Still other objects, features and attendant advantages of the present invention will become apparent to those skilled in the art from a reading of the following detailed description of embodiments constructed in accordance therewith, taken in conjunction with the accompanying drawings.

DESCRIPTION OF THE PREFERRED EMBODIMENTS

Figure 1:
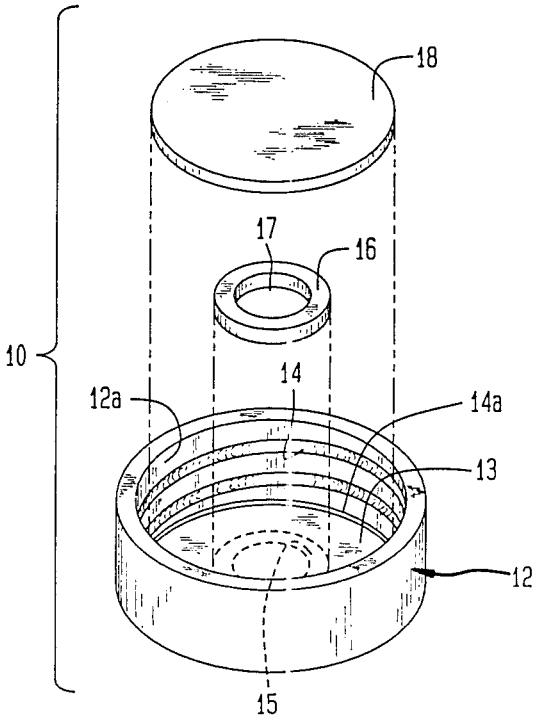
FIG. 1 is an exploded perspective view of an embodiment of a floating cap seal of the present invention.

The presently preferred embodiment of the present invention is illustrated in FIG. 1 of the drawings. The cap construction 10 comprises the combination of a cap or closure 12, an annular ring 16, and a floating gasket, liner or seal 18.

Cap 12 includes a bottom wall 13 and an adjacent vertically extending circular wall 12*a* having screw threads 14 on its internal surface for mating with complementary screw threads on a bottle top in the usual way. Adjacent its internal surface, the bottom wall 13 is adapted to non-securely receive the annular ring 16 in an abutting relationship, as shown in phantom at 15. It should be understood that the ring 16 may be fixedly positioned or may be free to rotate against the interior surface of the bottom wall 13.

Figure 2:
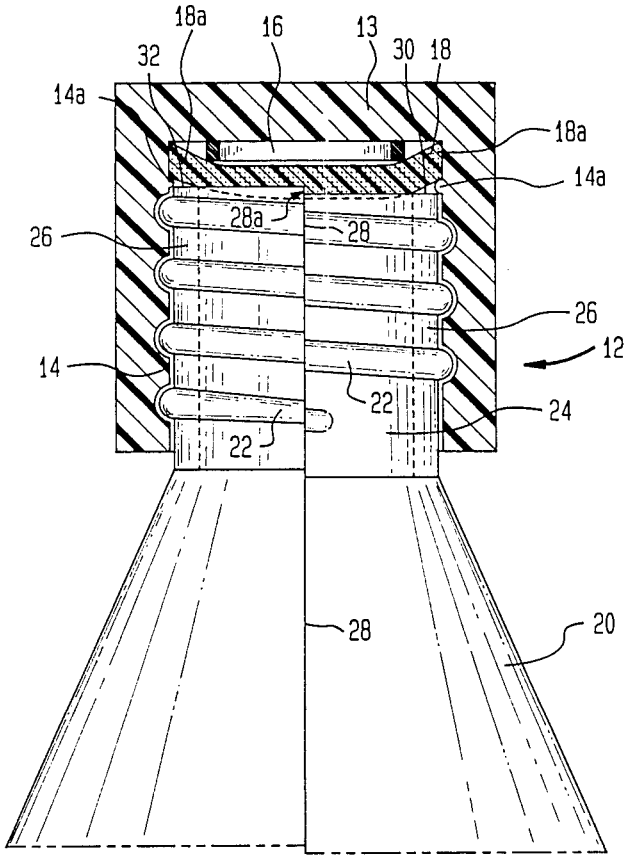
FIG. 2 is an elevational view shown in partial cross-section of the floating cap seal of FIG. 2 shown secured to a bottle opening.

The cap 12 may be formed through conventional molding techniques of any suitable plastic material, such as polystyrene, polypropylene, high density polyethylene, etc., as is common. The threads 14 are integrally molded on the interior of circular wall 12*a* to matingly engage with threads 22 provided on the bottle neck wall 24 as shown in FIG. 2.

The gasket or seal 18 is a thin liner and is adapted to be inserted over the ring 16, so that ring 16, including its central opening 17, may be sandwiched between the seal 18 and the cap bottom wall 13 and so that the seal 18 will "float" and rotate on the ring 16. Seal 18 is held within the cap 12 through the use of annular spaced projections or a lip 14*a* which is integrally molded on the interior surface of circular wall 12*a* just slightly above the bottom wall 13. Projection 14*a* allows the seal 18 to be snap fitted within the cap, thereby retaining the ring 16 therebetween. These holding means 14*a* are not, however essential, and may be eliminated, in which case the liner 18 will extend horizontally in the same way as the liner shown in FIG. 5A.

It should be noted that the diameter of the seal 18 is substantially the same as that of the interior diameter of the cap 12 or the exposed portion of its bottom wall 13. The seal may be conventional and is preferably formed of foamed or unfoamed polyolefin or vinyl chloride resin, or any other suitable material which possesses semi-flexible or flexible properties, as well as resilient characteristics. The thickness of the seal 18 may vary considerably, although it is preferably of a thickness ranging from about 0.010 to 0.040 inches.

Figure 3:
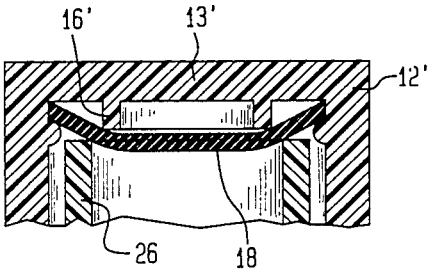
FIG. 3 is a partial cross-sectional view of another embodiment in accordance with the instant invention.

The ring 16 may be formed from materials similar to the cap 12 and should possess more rigidity than that of the seal 18. It should be understood that it is important that the diameter of ring 16 be at least slightly smaller than the internal diameter of the bottle neck opening. In other words, the ring must be at least slightly smaller than the pouring hole opening, and preferably considerably smaller than such opening, thereby providing clearance between the exterior of the ring 16 and the interior of the opening defined by the wall 26. This enables the seal or liner 18 to be deformed as generally illustrated in FIGS. 2 and 3 and as explained in more detail below. The height of the ring 16 must be sufficient to accomplish the desired objectives, and this will depend on a number of factors including the bottle size, accuracy of the bottle forming molds, etc.; in general, however, the minimum height should be about 0.062 inches, and a height of about 0.075 inches is sufficient for most purposes. Except for relatively large size bottles, the height will not normally exceed 0.20 inches.

Referring now to FIG. 2, the cap 12 is shown as being secured to an opening of a conventional plastic molded bottle 20. The container 20 includes a molding line 28, which is prevalent in these types of containers, the molding line causing the end portion 30 and 32 to be uneven, i.e. in slightly different planes. It should be noted that surface 32 is slightly elevated over surface 30 causing an unsmooth sealable surface. As the cap 12 is tightened around the container neck 24, seal 18 abuts against the end surfaces 30,32 of the container opening causing the peripheral portion 18*a* of the seal to flex upward forming a complete seal across uneven surface 28*a*. This is accomplished due to the fact that the diameter of the ring is smaller than that of the diameter of the bottle opening. Essentially the ring 16 urges the central portion of seal 18 down over uneven surface 28*a* where the semi-circular ends 30,32 meet.

In general, the present invention solves the problems of the prior art by providing a flexible large sealing surface that is three-dimensional. This in turn is provided in a practical way by the provision of the ring 16 which creates an inverted conical surface with the small end of the cone inserted into the pouring hole, whereby the liner or seal 18 is flexibly deformed so that its central portion is pushed into the pouring hole sufficiently to take up any imperfections in the upper portion of the neck of the bottle. As noted above, the ring must be smaller, preferably considerably smaller, than the pouring hole to provide assembly clearance and allow a fit even if the pouring hole is oval. The relatively thin liner 18, placed over the annular ring 16 with its edges retained by either the peripheral ring 14*a* or a series of upstanding nodes, is then free to deform as noted.

Figure 5A:
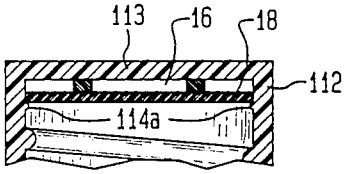
FIGS. 5A and 5B are partial cross-sectional views of yet another embodiment.
Figure 5B:
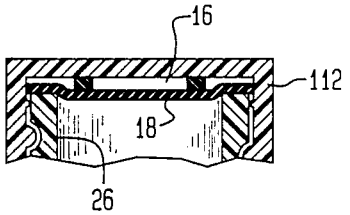
Figure 6:
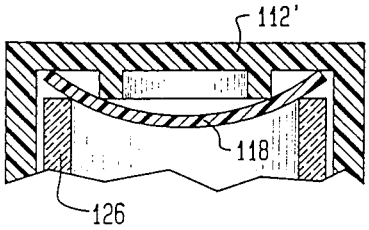
FIG. 6 is a partial cross-sectional schematic view of still another embodiment.

FIGS. 3 and 5B, and to a somewhat lesser extent also FIG. 2, show that the seal deforms to a generally frusto-conical configuration. On the other hand, FIG. 6 shows the liner deforming to a dome-shaped configuration. Either type of deformation is satisfactory for the purposes of the present invention, and the final shape of the seal will be dependent upon a number of factors including the degree and type of imperfection in the bottle and the properties of the seal itself. All other factors being equal, the dome-shaped configuration as shown in FIG. 6 is more likely to occur if the thickness of the seal is on the order of 20–35 mils, and the frustoconical configuration of FIGS. 3 and 5B is more likely to occur if the seal material is thinner, i.e. on the order of about 15 mils.

As the ring 16 is slightly higher than the top of the cap and the holding means 14*a* are below the surface of the annular ring, the liner will be flat over the annular ring and then subtend toward the edges and be held by the holding means 14*a*. This provides a conical sealing surface starting at the outside edge of the annular ring 16 and angularly progressing down and out toward the retaining lip 14*a*. The sealing liner 18 is free to turn with respect to the closure but approaches the pouring hole as an inverted cone, flexible and able to take up imperfections of a bad bottle.

FIG. 3 shows a variation from the embodiment of FIGS. 1 and 2 wherein a cap 12' is formed unitary with a ring 16' which projects from the bottom surface of the wall 13'. This embodiment has the advantage of avoiding the formation and handling of a separate ring 16. Its disadvantages compared to the embodiment of FIGS. 1 and 2, on the other hand, are that the cap 12' must be specially constructed and a separate ring 16 cannot be used with a conventional cap; also in the embodiment of FIG. 3 when it is necessary for the liner 18 to rotate it can only rotate relative to the cap 12', whereas in the embodiment of FIGS. 1 and 2 a further degree of rotation is possible between the ring 16 and the cap 12.

Figure 4:
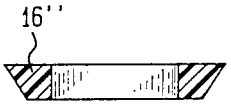
FIG. 4 is a cross-sectional view of a third form of annular ring for use in accordance with the instant invention.

FIG. 4 shows that the ring may have a cross-section other than rectangular. In this case, the ring 16'' is given a frustoconical configuration.

FIG. 5A shows an embodiment wherein the retaining means 114*a* for the liner 18 are spaced from the inside of the bottom wall 113 a distance roughly equal to the height of the annular ring 16 plus the thickness of the liner 18, and in this case the liner 18 will extend across the interior of the cap 112 in a generally planar manner, spaced from the interior surface of the wall 113 roughly equal to the height of the ring 16, in much the same manner that the liner 18 is retained when held in place by friction without any holding means 114*a*. FIG. 5B shows what happens during use of this construction, the liner being deformed peripherally by the bottle neck 26.

FIG. 6 shows an embodiment like that of FIG. 3 used in conjunction with a glass bottle 126. The seal 118 is of conventional thickness, i.e. on the order of 20–35 mils, and deforms in use to the dome-shaped configuration shown. The cap 112' differs from the cap of FIG. 3 in that no retaining lip is provided for the sealing disk 118.

Figure 7:
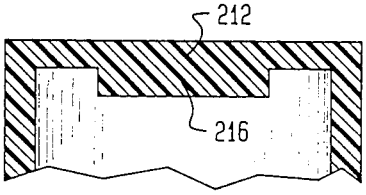
FIGS. 7, 8 and 9 are partial cross-sectional views of bottle caps useful in conjunction with the instant invention.
Figure 8:
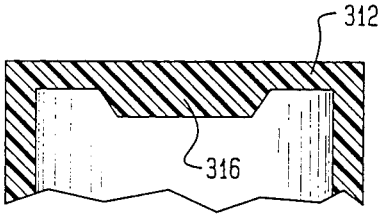
Figure 9:
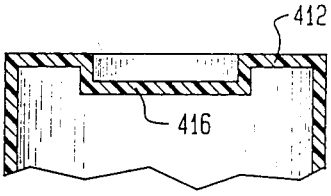

FIGS. 7, 8 and 9 show three variants of cap constructions which differ slightly from the caps of FIGS. 3 and 6. The cap 212 of FIG. 7 has a solid unitary ring portion 216. In FIG. 8, the cap 312 has a similar solid ring portion 316, except such ring portion 316 is provided with frustoconical configuration. FIG. 9 shows yet another variant in which the top of the cap 412 is configured in its exterior surface to define the ring 416.

The present invention provides a closure with a seal for a plastic blow molded bottle that will seal in spite of imperfect threads on the bottle, imperfect matching on the parting line of the bottle across the top and down the side over the threads, imperfect flat surfaces on the top of the bottle, either a tipped surface toward the pouring hole or an undulating surface around the circumference of the bottle and/or an imperfect diameter around the top of the bottle causing the neck to be oval. All of these imperfections can occur in combination at the same time, or individually.

In addition to the improved sealing achieved by the present invention as pointed out above, the annular ring provides an air space behind the liner. This air space provides an air cushion able to absorb sudden shocks due to the compression of the flexible bottle. This buffering action takes pressure off the seal and allows the seal to function in a static mode, minimizing "blow dry". Similarly, if the liquid in the bottle is one which can decompose (such as hydrogen peroxide), or contains a volatile solvent which may tend to evaporate, again the air space behind the liner is capable of cushioning this effect.

Because the sealing surface and density of the liner are the same as a standard liner, capping torques and backoff requirements of the industry are easily met. Additionally, the use of an annular ring in place of a solid disk eliminates a thick section in the cap and reduces the likelihood of sink marks.

It should also be understood that the ring and the seal could be made of varying sizes to conform to fit with caps having various diameters. The ring and seal could be inserted into already existing caps, particularly caps which are secured onto containers whose abutting closure surfaces are uneven or unplanar.

It will be obvious to those skilled in the art that various other changes and modifications may be made without departing from the scope of the invention and the invention is not to be considered limited to what is shown in the drawing and/or described in the specification.

What is claimed is:

1. A floating cap seal for closing a nonplanar bottle opening, comprising:

a screw cap having a generally planar bottom wall and an adjacent vertically extending circular internally threaded wall forming a cavity;

a thin, flat, resilient circular seal having a diameter substantially equal to the diameter of the cavity and lying within the cavity near the bottom thereof; and a circular ring having a height of at least about 0.062 inches, said ring having a smaller exterior diameter than the bottle opening, said ring being generally center located between said bottom wall and said circular seal to space said circular seal from said bottom wall, and said seal being adapted to freely rotate relative to said screw cap upon engagement with an upper edge of a bottle opening;

whereby said ring, sandwiched between said circular seal and said bottom wall, defines a rotatable floating seal to effect sealing of said non-planar bottle opening.

2. A floating cap seal in accordance with claim 1, wherein said vertically extending wall is provided with holding means for retaining the periphery of said circular seal, said holding means comprising at least one integrally formed projection on the cavity side of said vertically extending wall.

3. A floating cap seal in accordance with claim 2 wherein the distance between said holding means and said planar wall is slightly greater then the height of said ring.

4. A floating cap seal in accordance with claim 1, wherein said ring is unsecured to the bottom wall of said cap.

5. A floating cap in accordance with claim 1, wherein said ring is integral with said bottom wall of said cap.

6. A floating cap seal in accordance with claim 1, wherein the cross-section of said ring is rectangular.

7. A floating cap seal in accordance with claim 1, wherein the cross-section of said ring is generally frustoconical.

8. A floating cap seal in accordance with claim 1, wherein said ring is annular.

9. A floating cap seal in accordance with claim 1, wherein said ring is solid.

10. A floating cap seal for closing a non-planar bottle opening, comprising:

a screw cap having a bottom generally planar wall and an adjacent vertically extending circular internally threaded wall forming a cavity;

a resilient circular seal having a diameter substantially equal to the diameter of the cavity and lying within the cavity near the bottom thereof;

a circular ring having a smaller exterior diameter than the bottle opening, said ring being generally centrally located between said bottom wall and said circular seal to space said circular seal from said bottom wall; and said vertcially extending circular wall being provided with holding means for retaining the periphery of said circular seal, said holding means comprising at least one integrally formed projection on the cavity side of said vertically extending wall, the distance between said bottom planar wall and said holding means being less than the height of said circular ring;

whereby, said ring, sandwiched between said circular seal and said bottom wall, defines a rotatable floating seal to seal said non-planar bottle opening.

11. A combination of a bottle, cap and floating cap seal, comprising:

a bottle having a generally tubular neck portion with an external screw thread and an upper edge;

a screw cap having a generally planar bottom wall and an adjacent vertically extending circularly internally threaded wall forming a cavity, said internally threaded wall cooperating with said external thread of said bottle neck;

a resilient circular seal having a diameter substantially equal to the diameter of the cavity of said screw cap and lying within the cavity near the bottom thereof, said seal having a central area and a peripheral area; and a circular ring having a height of at least about 0.062 inches, said ring having a smaller exterior diameter than the opening of said bottle, said ring being generally centrally located between said bottom wall of said screw cap and said circular seal to space said circular seal from said bottom wall;

whereby, said ring, sandwiched between said circular seal and said bottom wall, has its peripheral area forced toward said bottom wall while its central area projects downwardly within the opening of the neck of the bottle.

12. The combination according to claim 11, wherein said vertically extending wall is provided with holding means for retaining the periphery of said circular seal, said holding means comprising at least one integrally formed projection on the cavity side of said vertically wall.

13. The combination according to claim 12, wherein the distance between said holding means and said planar wall is slightly greater than the height of said ring.

14. The combination according to claim 11, wherein said ring is unsecured to the bottom wall of said cap.

15. The combination according to claim 11, wherein said ring is integral with the bottom wall of said cap.

16. The combination according to claim 11, wherein the cross-section of said ring is rectangular.

17. The combination in accordance with claim 11, wherein the cross-section of said ring is generally frustoconical.

18. The combination according to claim 11, wherein said ring is annular.

19. The combination according to claim 11, wherein said ring is solid.

* * * * *